US009211758B2

(12) United States Patent
Poisel et al.

(10) Patent No.: US 9,211,758 B2
(45) Date of Patent: Dec. 15, 2015

(54) LUMINOUS PENCIL

(75) Inventors: Hans Poisel, Leinburg (DE); Olaf Ziemann, Nürnberg (DE); Alexander Bachmann, Nürnberg (DE)

(73) Assignee: FABER-CASTELL AG, Stein (DE)

( * ) Notice: Subject to any disclaimer, the term of this patent is extended or adjusted under 35 U.S.C. 154(b) by 905 days.

(21) Appl. No.: 13/038,816

(22) Filed: Mar. 2, 2011

(65) Prior Publication Data

US 2011/0199782 A1 Aug. 18, 2011

Related U.S. Application Data

(63) Continuation of application No. PCT/EP2010/064854, filed on Oct. 5, 2010.

(30) Foreign Application Priority Data

Oct. 17, 2009 (DE) ..... 10 2009 049 722

(51) Int. Cl.
*B43K 29/10* (2006.01)

(52) U.S. Cl.
CPC ..... *B43K 29/10* (2013.01)

(58) Field of Classification Search
CPC ..... B43K 29/10
USPC ..... 362/579, 582, 118
See application file for complete search history.

(56) References Cited

U.S. PATENT DOCUMENTS

| | | | | | |
|---|---|---|---|---|---|
| 2,261,320 | A * | 11/1941 | Williams | 362/579 |
| 2,407,106 | A * | 9/1946 | Shelly | 362/579 |
| 2,811,632 | A * | 10/1957 | Bartlett | 362/579 |
| 3,502,859 | A * | 3/1970 | Kochan | 362/579 |
| 5,446,633 | A * | 8/1995 | Hanggi | 362/118 |
| 6,164,856 | A * | 12/2000 | Lo | 401/52 |
| 6,390,641 | B1 * | 5/2002 | Liu | 362/118 |
| 6,409,407 | B1 * | 6/2002 | Schweizer | 401/192 |
| 6,860,616 | B2 * | 3/2005 | Yu et al. | 362/118 |
| 6,943,670 | B2 * | 9/2005 | Liguori et al. | 340/321 |
| 7,393,114 | B2 * | 7/2008 | Devlin | 362/109 |
| 2002/0044442 | A1 * | 4/2002 | Brown | 362/118 |
| 2004/0161287 | A1 | 8/2004 | Yu | |
| 2007/0053180 | A1 | 3/2007 | Jones et al. | |
| 2007/0097671 | A1 * | 5/2007 | Walsh | 362/118 |

FOREIGN PATENT DOCUMENTS

CN 2036491 U 4/1989

* cited by examiner

*Primary Examiner* — Jong-Suk (James) Lee
*Assistant Examiner* — Bryon T Gyllstrom
(74) *Attorney, Agent, or Firm* — Laurence Greenberg; Werner Stemer; Ralph Locher

(57) ABSTRACT

A pencil has a pencil casing made of a sharpenable casing material and a core held in a central receiving bore in the casing material that extends in the longitudinal direction of the pencil. One or more optical fibers made of a sharpenable material is/are arranged in the pencil casing. The optical fiber or optical fibers extends in the longitudinal direction as well and are at least partially surrounded by the material of the pencil casing. A light entry surface of the at least one optical fiber is arranged at the rear end of the pencil casing such that a light source, which is present there, can be used to inject light to said light entry surface. The light exit surface of the optical fiber exits at the forward end of the pencil casing.

23 Claims, 5 Drawing Sheets

LUMINOUS PENCIL

CROSS-REFERENCE TO RELATED APPLICATION

This application is a continuation, under 35 U.S.C. §120, of copending international application No. PCT/EP2010/064854, filed Oct. 5, 2010, which designated the United States; this application also claims the priority, under 35 U.S.C. §119, of German patent application No. DE 10 2009 049 722.6, filed Oct. 17, 2009; the prior applications are herewith incorporated by reference in their entirety.

BACKGROUND OF THE INVENTION

Field of the Invention

The invention relates to a pencil with a pencil casing made of a sharpenable casing material, for example of wood or plastic, and a core held in a central receiving bore in the pencil casing that extends in the longitudinal direction of the pencil. In a pencil of this type, after a core section that protrudes from the forward end of the pencil has been used up, part of the pencil casing is typically removed with the aid of a pencil sharpener in order to expose a further core section.

SUMMARY OF THE INVENTION

It is an object of the invention to provide a pencil which is improved in terms of its utilitarian design and which has an alternative design that provides an improvement in particular in terms of its handling and its possible applications.

With the foregoing and other objects in view there is provided, in accordance with the invention, a pencil, comprising:

a pencil casing formed of a sharpenable casing material, said pencil casing having a rear end, a forward end, and a central receiving bore formed therein extending in a longitudinal direction defined by said pencil casing;

a core disposed in said central receiving bore of said pencil casing;

at least one optical fiber at least partially surrounded by said casing material of said pencil casing and extending in the longitudinal direction, said at least one optical fiber being made of a sharpenable material and having a light entry surface disposed at said rear end of said pencil casing and a light exit surface at said forward end of said pencil casing; and a light source disposed at said rear end of said pencil casing and configured to inject light at said light entry surface, wherein light exits at said light exit surface of said optical fiber at said forward end of said pencil casing.

In other words, the objects of the invention are achieved by providing a pencil as outlined above which, in addition, has at least one optical fiber in the pencil casing and which extends in the pencil's longitudinal direction. The optical fiber is also made of a sharpenable material and the light entry surface of it is arranged at the rear end of the pencil casing such that a light source, which is present there, can be used to apply light to said light entry surface. The light exit surface of the optical fiber exits at the front end of the pencil casing. The light exit surface is movable, as it were, when the pencil front end is sharpened. Firstly, such a pencil can be used, if required, to illuminate a surface on which a core deposit takes place, such as paper in the case of a writing, drawing or sketching pencil or the skin in the case of a cosmetics pencil. In addition to visible light, a surface of the type mentioned can also be irradiated with UV or infrared light, for example in order to effect a crosslinking reaction in a UV-curable core mass transferred onto the surface or in order to accelerate the drying of a core mass by addition of heat using IR radiation.

A light source, which emits for example in the visible, UV or IR range of the electromagnetic spectrum, and a power source, which serves for supplying power to the light source, such as one or more button cells or chargeable batteries, are accommodated in a container located at the rear pencil end at least when the pencil is in use. This container may be connected to the pencil fixedly or preferably detachably. In the latter case, the container, which is preferably in the form of a pencil extension or a pencil cap, can be used further in a new pencil after a pencil has been used up. In order to ensure the sharpenability of the pencil casing, which consists of materials such as wood, plastic or wood-plastic compounds, the optical fibers used are made of a sharpenable plastic such as PMMA, PC, PS, ABS or PET, for example having a diameter of 250 μm to 1000 μm, preferably at most 500 μm.

Other features which are considered as characteristic for the invention are set forth in the appended claims.

Although the invention is illustrated and described herein as embodied in a luminous pencil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
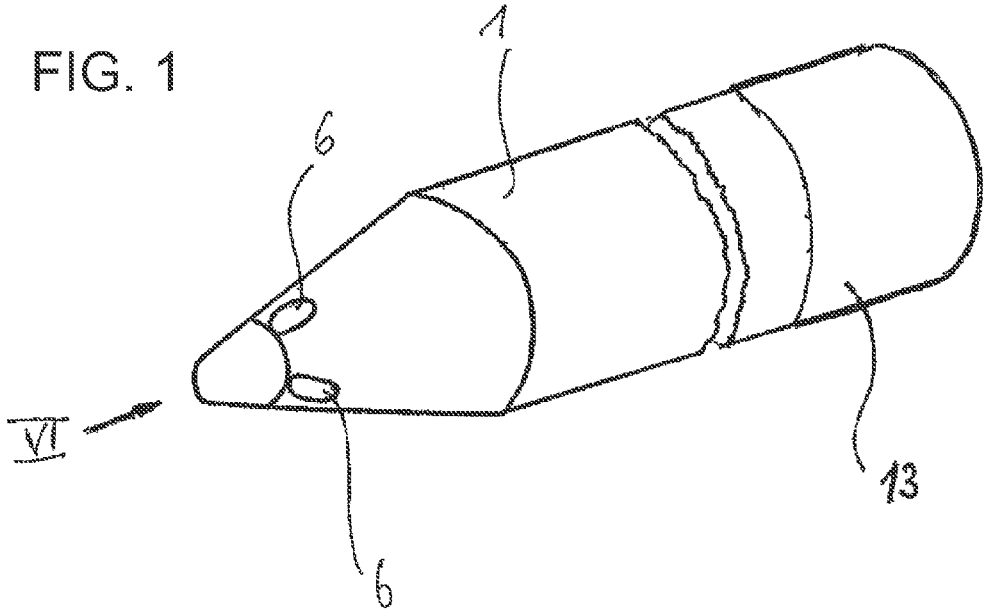
FIG. 1 shows a perspective illustration of a pencil with a sharpenable pencil sheath.

Referring now to the figures of the drawing in detail the pencils of the embodiments shown in the figures all comprise a pencil sheath or casing 1 made of a sharpenable material. The casing 1 is formed with a receiving bore or hole 3 extending through the pencil casing in its longitudinal direction or coaxially to its central longitudinal axis 2. The receiving bore 3 is filled with a core mass forming a core 4. When the core is in the sharpened state—i.e., when a tip 5 is formed at the forward end of the pencil—the core protrudes from the pencil casing 1. As mentioned, the pencil casing consists of a sharpenable material for example wood, with cedar, poplar, linden, pine, pulai and gmeline being particularly suitable here. The pencil casing 1 can also consist of a plastics material as long as it has a consistency that is amenable to sharpening, for example by a corresponding addition of plasticizers or other measures. Suitable for this are, for example, olefins or cellulose acetate butyrate or cellulose propionate with a proportion of a plasticizer, for example of a fatty acid ester, of 5 to 35 percent by weight. The pencil casing 1 can also consist, for example, of composite materials, such as a wood-plastic compound.

Figure 2:
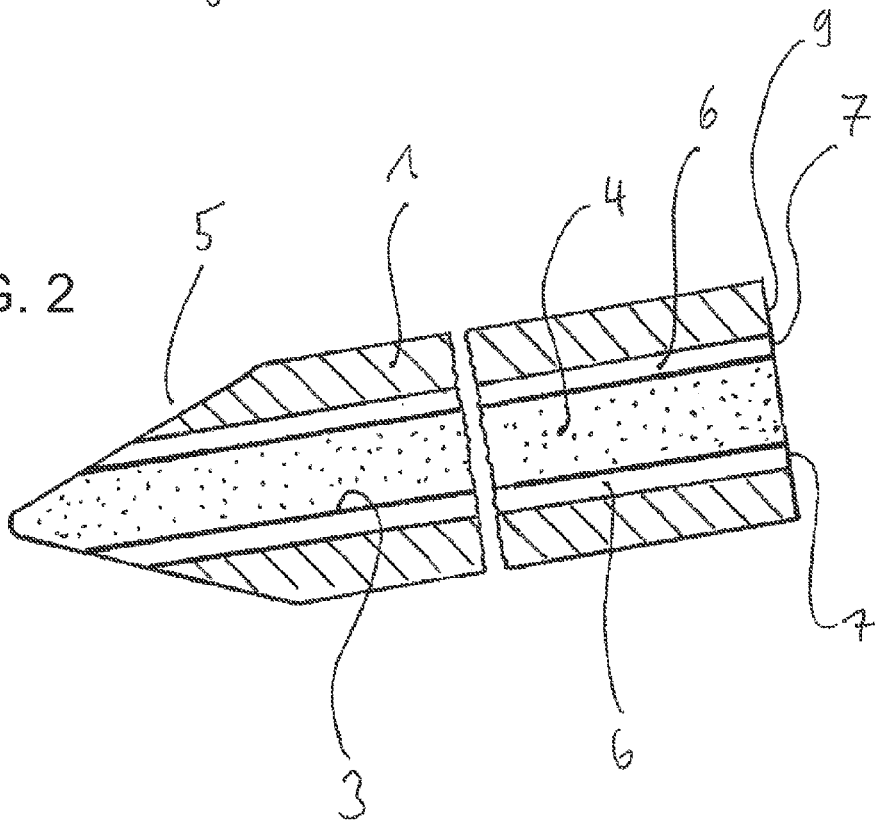
FIG. 2 shows a longitudinal section through the pencil in FIG. 1.
Figure 6:
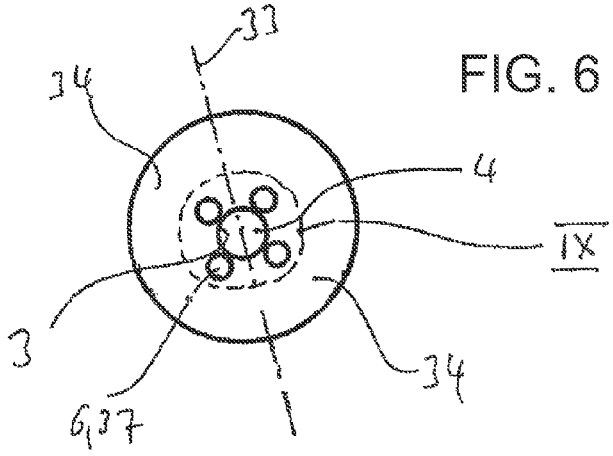
FIG. 6 shows a front view of the pencil in FIG. 1, viewed in the direction of the arrow VI shown in FIG. 1.
Figure 7:
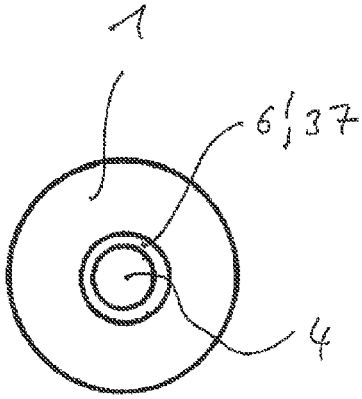
FIG. 7 shows an image, corresponding to FIG. 6, of a different design of a pencil.

A plurality of optical fibers 6 are disposed in the pencil casing 1, with the optical fibers 6 being at least partially surrounded on their entire length by the pencil casing 1 or by the material forming that pencil casing. An optical fiber of the type mentioned here usually consists of a plastic such as PMMA, PC, PS, ABS or PET, with PMMA being particularly preferred. If only one optical fiber 6' is used, it is preferably designed as a hollow fiber which encloses the core 4 concentrically (FIG. 7). In this case, the optical fiber 6' can serve as a barrier between the core 4 and the pencil casing 1 and can prevent substances from migrating from the core mass 4 into the pencil casing 1 which consists, for example, of wood. If a plurality of optical fibers 6 are used, they are preferably disposed in a coaxial arrangement around the core 4 with uniform radial spacing and uniform spacing in the circumferential direction (FIG. 6). Electromagnetic radiation, such as light, which is injected or coupled in from the rear end of the optical fibers, then produces on a substrate a light spot which surrounds the core 4. Arranging the rear end surface, which forms a light entry surface 7, of the optical fibers 6 at the rear pencil end such that light can be applied to the end surface using a light source 8 which is present there ensures that radiation is coupled into the optical fibers 6 from the rear pencil end. As can be seen in FIG. 2, this can be realized by the light entry surface 7 of an optical fiber 6, as is the case for optical fiber 6' (FIG. 7), being flush in one plane with the rear end surface 9 of the pencil casing 1. A light source 8, for example in the form of an LED, is arranged such that it is spaced apart from the rear end surface 9 of the pencil or of the pencil casing 1 with a certain axial spacing 28, as is shown for example in FIG. 4.

Figure 3:
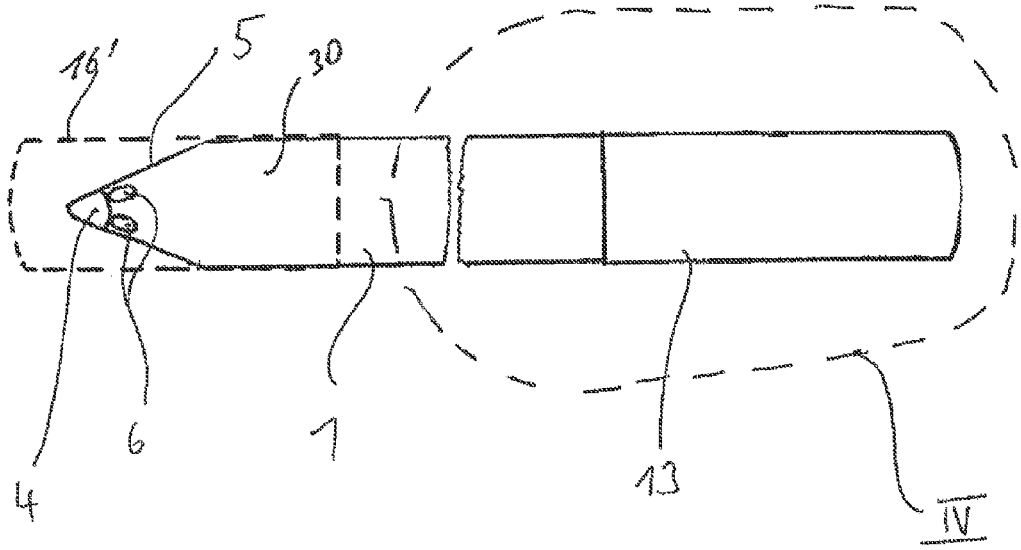
FIG. 3 shows a side view of the pencil in FIG. 1.
Figure 4:
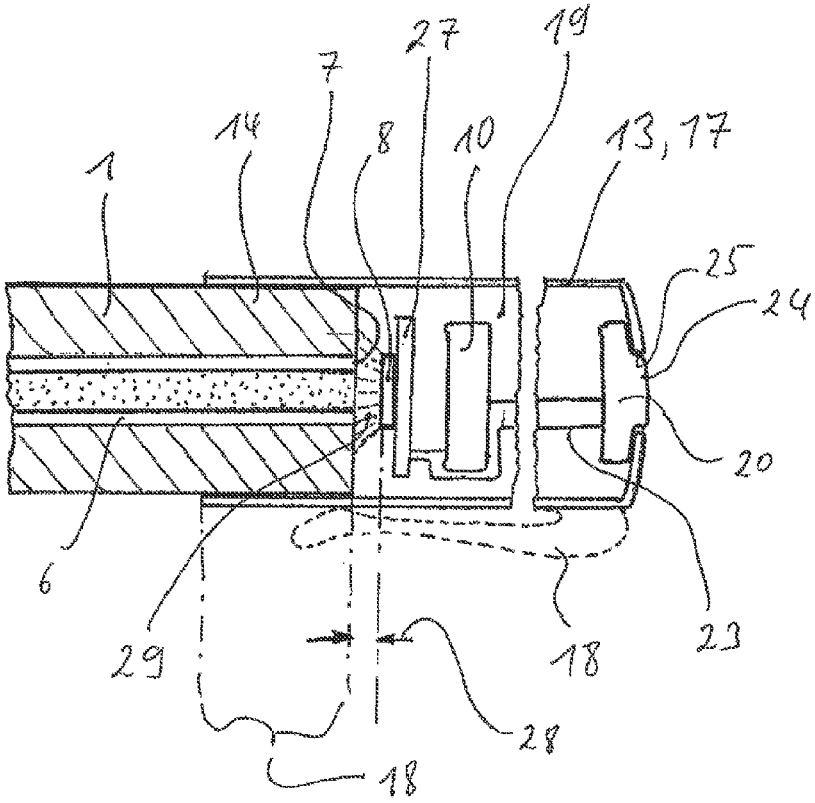
FIG. 4 shows a slightly enlarged detail IV in FIG. 3.
Figure 10:
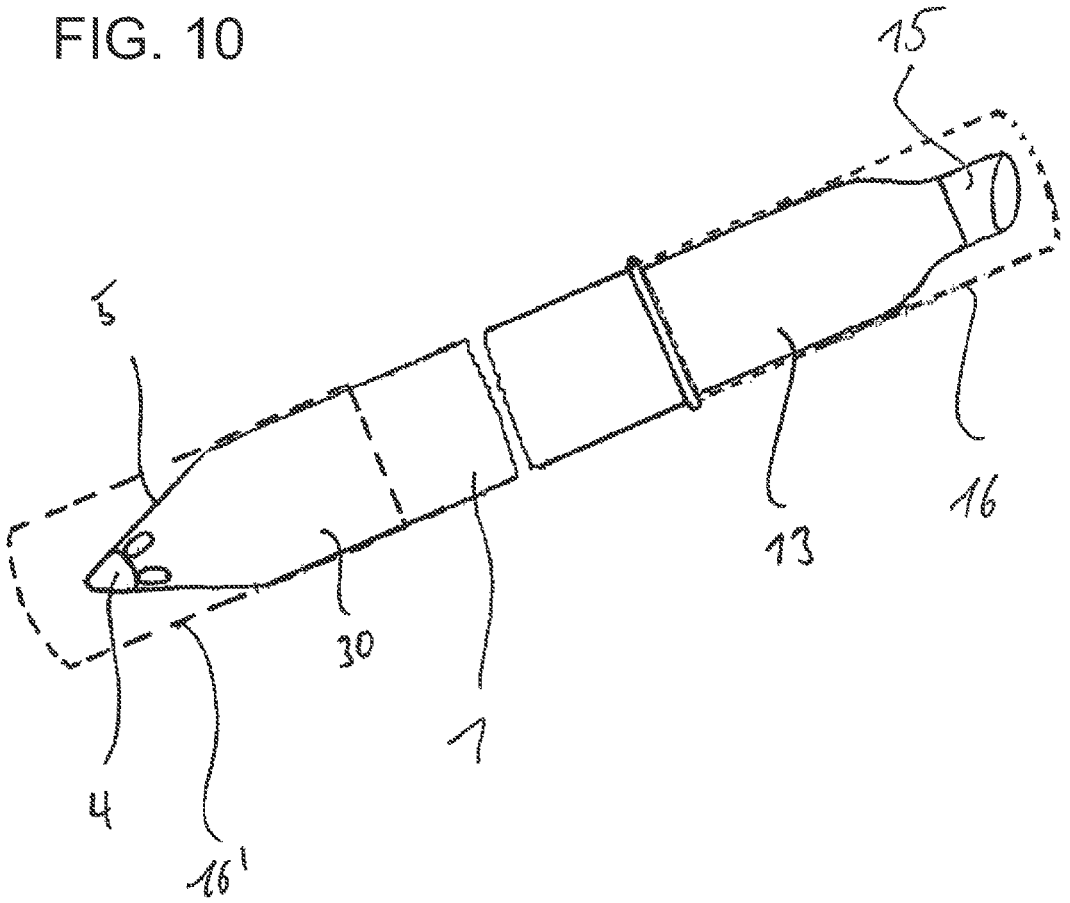
FIG. 10 shows a side view of a pencil having a container provided with a fitting element.

In a preferred embodiment variant, a light source 8, a power source 10 and optionally a switch 20 for switching the light source 8 on and off are arranged in a container 13, which is designed in the manner of a sleeve and is fixed, at least while the pencil is in use, at the rear end 14 of the pencil casing 1, for example plugged thereon or screwed thereon (see FIGS. 4, 10). The connection between the container 13 and the pencil casing 1 can be fixed and non-detachable, for example a clamping connection. If the container 13 is fixed to the pencil casing 1 in a detachable or non-detachable manner, it can carry a fitting element 15 at its free end (FIG. 10). In a cosmetics pencil, the fitting element can be for example a small sponge or a small brush, and in a writing or drawing pencil it can be, for example, an eraser. For the protection of the fitting element 15 a closure cap 16 is plugged onto the container 13*a*. A closure cap 16' can generally also be provided for the forward end or front end 30 of the pencil casing, as is shown by way of example in FIG. 3 and FIG. 10.

A container 13, which is fixed detachably to the pencil casing 1, is preferably designed as a pencil extension or extender 17, with a holding clip 11 optionally being disposed on it (FIG. 4). The pencil extension 17 has a receiving region 18 which serves for insertion of the rear pencil end 14. This is adjoined by a space 19, in which the light source 8 and the power source 10 are arranged and held by a suitable carrier structure (not shown). Furthermore, a switch 20 or at least part of a switch 20 is arranged in the space 19. The switch 20 is integrated in an electric circuit 23, which comprises the light source 8 and the power source 10, and is designed by way of example as a pressure switch, with a switching element 24 that serves for pressure activation being accessible from outside via an opening 25 in the container 13 or in the pencil extension 17. However, the switch 20 can also be a slide switch or, as is the case in the example shown in FIG. 8, a rotary switch having a rotatable switching element 26 which is, for example, in the form of a circular disk. The light source 8, which is fixed for example on a printed circuit board 27, is arranged with an axial spacing 28 from the rear end surface 9 of the pencil casing 1 or from the light entry surface 7 of an optical waveguide 6, 6'. The axial spacing 28 ensures that a light cone 29, emitted by the light source 8, covers all available light entry surfaces 7 such that light can be coupled into the optical waveguides 6, 6'. An additional optical element such as a converging lens, for example, is not necessary for this. The coupling of light into an optical fiber can be facilitated by designing the optical fiber 6, 6' such that it has a relatively large acceptance angle or a numerical aperture of greater than 0.3.

Figure 5:
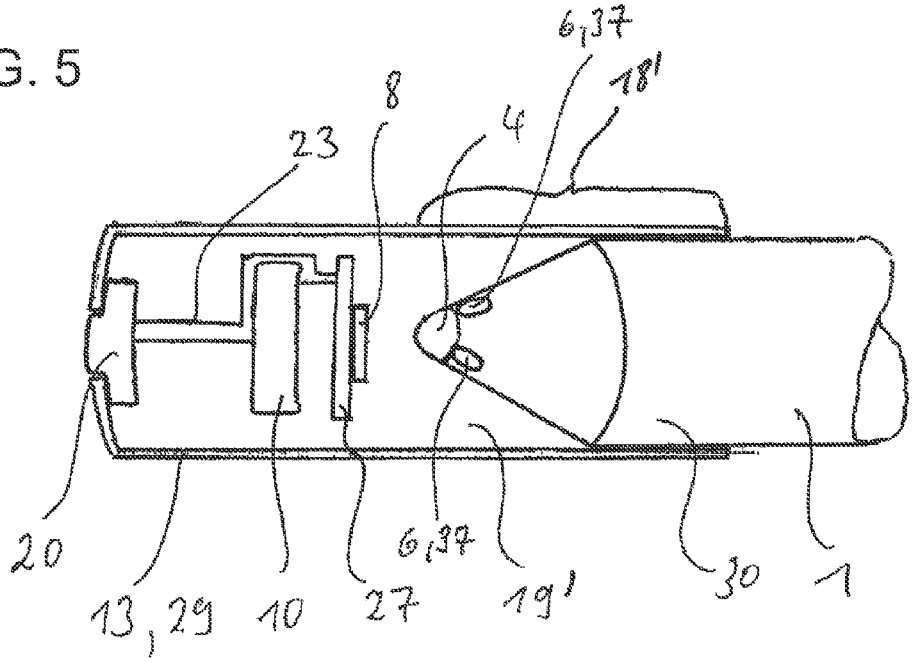
FIG. 5 shows an illustration of the front part of a pencil in partial section, in which the container is a pencil cap which can be plugged onto the rear end of the pencil.

A container 13, which can be detachably fixed to the rear end 14 of the pencil casing 1, can also be designed as a closure cap 29 which can be plugged onto the forward end 30 of the pencil casing 1 in order to protect the core 4 (FIG. 5). The closure cap 29 has a receiving region 18', with which the closure cap 29 can be plugged onto the forward end 30 of the pencil casing 1. The light source 8, the power source 10, a switch 20 and an electric circuit 23 are arranged in an adjoining space 19' of the closure cap 29. The space 19' can likewise contain a printed circuit board 27 carrying the light source 8. During use of the pencil shown in FIG. 5, the closure cap 29 is removed and plugged with its receiving region 18 onto the rear end 14 of the pencil casing. It can then not be coupled into an optical waveguide 6 for one of the purposes explained further below.

Figure 8:
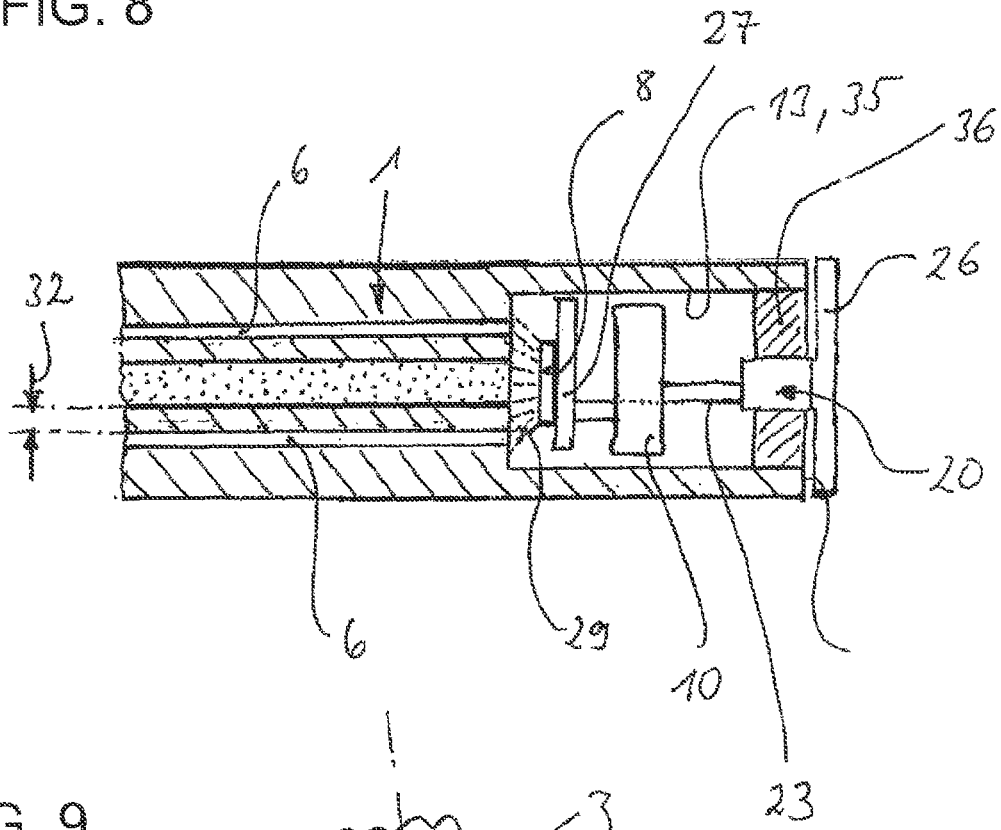
FIG. 8 shows a longitudinal section through the rear part of a pencil, in which the container is formed by a cutout in the pencil casing.
Figure 9:
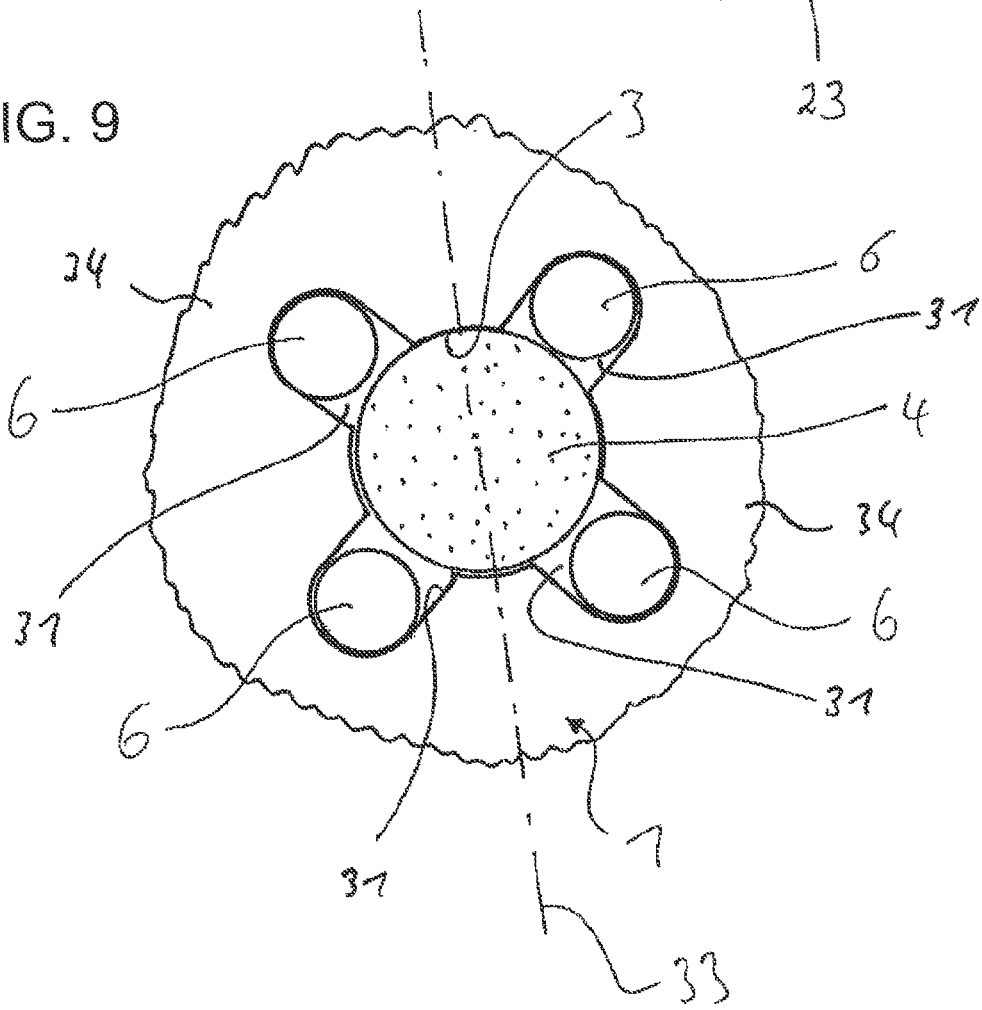
FIG. 9 shows the detail IX in FIG. 6.

In the case of a pencil casing 1 which consists of a thermoplastic, an optical waveguide 6 can be embedded into the plastics material, which can be realized for example by way of producing the pencil casing 1 by coextrusion. In this case, it is easily possible to maintain, if necessary, a radial spacing 32 between core 4 and an optical fiber 6 or 6', with the result that the core is surrounded completely by the material of the pencil casing 1 on its entire length (FIG. 8). In the case of plastics or other non-extrudable materials, it is expedient for the sake of simplifying the production if an optical fiber 6 is arranged in a groove 30 which opens into the receiving bore 3. The groove 30 can be produced easily using for example a milling cutter inserted into the receiving bore. Production of a groove 30 can be even easier if the pencil casing consists of two halves 34 joined together by a joint 33 (see FIGS. 6, 10).

In the exemplary embodiment shown in FIG. 8, the rear end 14 of the pencil casing 1 contains a cutout 35 forming the container 13. Arranged in this cutout are the abovementioned components, that is to say light source 8, power source 10 and electric circuit 23. Optionally, the receiving portion 35 can contain the printed circuit board 27 likewise mentioned above. The same is true for a switch 20. Said switch can be arranged at least in part in a closure plug 36 which closes the cutout 35 to the rear. In the exemplary embodiment shown in FIG. 8, the switch 20 is designed as a rotary switch and accordingly has a rotatable switching element 26 in the form of a circular disk, which serves for rotary actuation, as already mentioned further above.

Depending on the type of desired use of a pencil according to the invention, a light source 8, preferably a light-emitting diode, is chosen which emits the suitable radiation for the respective intended application. If the aim is to improve the use of the pencil under poor light conditions, a light source 8 which emits visible light is used. On account of the close proximity of the optical fibers 6 or their light exit surfaces 37 to the core 4, the region of a writing or drawing substrate or a skin region on which a core deposit is meant to take place is illuminated. In another use, a light source 8 which emits light in the ultraviolet range rather than visible light is used, for example a light-emitting diode on aluminum nitride basis or aluminum gallium nitride basis. In this case, the core consists of a UV-crosslinkable core mass.

Curing of a deposit can then take place preferably while the deposit on a writing or drawing substrate is produced, for example with the aim to produce a waterproof coating which adheres fixedly to the substrate. Finally, a light source which emits infrared radiation preferably in a wavelength range of 1 μm to 2 μm can be used as the light source 8, for example a light-emitting diode on gallium arsenide basis. Such a use is sensible for example in the field of cosmetics. The user perceives the warming infrared radiation during application of the core mass onto the skin as pleasant. In addition, the infrared radiation can generally be used to heat a deposit of core mass produced on a substrate in order to accelerate drying thereof.

The invention claimed is:

1. A pencil, comprising:

a pencil casing formed of a sharpenable casing material, said pencil casing having a rear end, a forward end, and a central receiving bore formed therein extending in a longitudinal direction defined by said pencil casing;

a core disposed in said central receiving bore of said pencil casing;

at least one optical fiber at least partially surrounded by said casing material of said pencil casing and extending in the longitudinal direction, said at least one optical fiber being made of a sharpenable material and having a light entry surface disposed at said rear end of said pencil casing and a light exit surface at said forward end of said pencil casing; and a light source disposed at said rear end of said pencil casing and configured to inject light at said light entry surface, wherein light exits at said light exit surface of said optical fiber at said forward end of said pencil casing.

2. The pencil according to claim 1, which comprises a container disposed at said rear end of said pencil casing, said container accommodating said light source and a power source at said rear end of said pencil casing.

3. The pencil according to claim 2, wherein said container is detachably affixed to said pencil casing.

4. The pencil according to claim 3, wherein said container is a pencil extender.

5. The pencil according to claim 3, wherein said container is a closure cap serving to protect said forward end of the pencil.

6. The pencil according to claim 2, wherein said container is a cutout formed in said rear end of said pencil casing.

7. The pencil according to claim 6, which further comprises a closure element closing said cutout.

8. The pencil according to claim 2, wherein said container carries a fitting element.

9. The pencil according to claim 1, which further comprises a switch for selectively switching said light source on and off.

10. The pencil according to claim 9, which comprises a container disposed at said rear end of said pencil casing and having said switch arranged at least in part in said container.

11. The pencil according to claim 1, wherein said at least one optical fiber has a diameter of between about 250 μm and about 1000 μm.

12. The pencil according to claim 1, wherein said at least one optical fiber consists of a plastic material selected from the group consisting of PMMA, PC, PS, ABS and PET.

13. The pencil according to claim 1, wherein said at least one optical fiber is disposed in a groove formed radially outwardly in said receiving bore.

14. The pencil according to claim 1, wherein said at least one optical fiber is one of a plurality of optical fibers.

15. The pencil according to claim 14, wherein said optical fibers are arranged equidistally in a circumferential direction of the pencil or of said core.

16. The pencil according to claim 1, wherein said optical fiber is a hollow fiber concentrically encasing said core.

17. The pencil according to claim 1, wherein said light source is a light source for visible light.

18. The pencil according to claim 1, wherein said light source is a light source emitting infrared light.

19. The pencil according to claim 1, wherein said light source is a light source emitting UV light.

20. The pencil according to claim 19, wherein said core contains a core mass which is crosslinkable with UV light.

21. The pencil according to claim 1, wherein said pencil casing is made of wood.

22. The pencil according to claim 1, wherein said pencil casing is made of plastic.

23. The pencil according to claim 1, wherein said pencil casing is made of a wood-plastic compound.

* * * * *